United States Patent [19]

McManus

[11] Patent Number: 4,830,142

[45] Date of Patent: May 16, 1989

[54] PORTABLE FENCE STILE

[76] Inventor: Bernard T. McManus, Box M, Lander, Wyo. 82520

[21] Appl. No.: 261,723

[22] Filed: Oct. 24, 1988

[51] Int. Cl.[4] ..... E06C 1/06; E06C 7/08

[52] U.S. Cl. ..... 182/92; 182/100; 182/189

[58] Field of Search ..... 182/100, 189, 92, 178, 182/16, 93

[56] References Cited

U.S. PATENT DOCUMENTS

| | | | |
|---|---|---|---|
| 455,639 | 7/1891 | Roden | 182/189 |
| 3,026,962 | 3/1962 | Kramer | 182/189 |
| 3,259,209 | 7/1966 | Brown | 182/92 |
| 3,561,563 | 2/1971 | Harsh | 182/92 |
| 3,817,351 | 6/1974 | Mikkelson | 182/189 |
| 4,249,635 | 2/1981 | West | 182/92 |
| 4,265,333 | 5/1981 | Rowell | 182/92 |

*Primary Examiner*—Reinaldo P. Machado
*Attorney, Agent, or Firm*—L. E. Massie

[57] ABSTRACT

A portable fence stile comprising a metal tube of length greater than the height of the vertical fence support posts. The tube having longitudinal vertical slots on opposite sides extending from the bottom to a height slightly greater than the height of the top fence horizontal wire. Stepping distance from the bottom of the tube flat horizontal foot rests extending outwards from the tube on each side of the longitudinal slots. A pliable strap slidably affixed to the longitudinal slot for compressively holding the ends of the tube to prevent spreading or the attach the stile tube to a vertical wood fence post. A rigid horizontal handle at the top of the tube provides climber support.

1 Claim, 1 Drawing Sheet

PORTABLE FENCE STILE

BACKGROUND OF THE INVENTION

1. Field of the Invention

When barbed wire fences came into general use the need arose for devices to assist persons needing to cross the fences. In rural areas the fence structure usually comprised vertical wood, or metal, posts supporting spaced horizontal barbed wire. Persons climbing over or between the barbed wire were exposed to injury from the sharp barbs of the wire. Portable devices to assist the persons crossing the fences such as portable steps, or stiles, entered the market place.

2. Description of the Prior Art

Of the many devices described in the prior art the Portable Fence Stile, U.S. Pat. No. 4,265,333 is probably the most pertinent. This patent teaches a U-shaped metal tubing placed over the fence in a generally vertical position. The metal tube having horizontal rods extending outwardly as foot supports.

The devices described in the prior art do not have the strength, stability and adaptability of the instant invention.

SUMMARY OF THE INVENTION

It is an objective of the instant invention to provide a sturdy portable fence stile that is useful on fences having either vertical metal posts or wood posts. The stile comprises a metal tube of an inside diameter sufficient to enclose the average metal fence post and a height to extend above the post. Longitudinal slotted openings on each side extend from the bottom of the tube to a height above the top horizontal wire of the fence. Stepping distance from the bottom of the tube metal steps extend outwardly from the tube on each side of the longitudinal slot. The metal steps having a serrated surface culminating in a vertical portion to prevent the foot from slipping off the step.

A longitudinal pliable fabric, or leather, strap with Velcro or similar material on each extremity having a rigid nodule fastened to the center. The nodule larger in diameter than the width of the longitudinal slot in the tube is spaced away from the strap allowing the nodule to slide along the slot and detachable only at the open bottom of the tube.

A horizontal handle is affixed to the top of the portable fence stile tube.

In use with a metal fence post the tube is placed over the post with the longitudinal slot accommodating the horizontal fence wires. The pliable strap is slid downwards to a position near the bottom of the tube and fastened to prevent spreading of the tube ends.

Where the fence is supported by wood posts the tube is placed adjacent to the post and the pliable strap is slid upwards to a mid point on the tube and secured circumferentially around the wood post and tube.

The inherent stiffness of the tube coupled with the support of the pliable strap provides a sturdy support for the stile steps, the upwardly extending ends of the steps preventing the foot from sliding off the step.

DETAILED DESCRIPTION OF THE PREFERRED EMBODIMENT

Figures 1, 2, 3, 4, 5, 6:
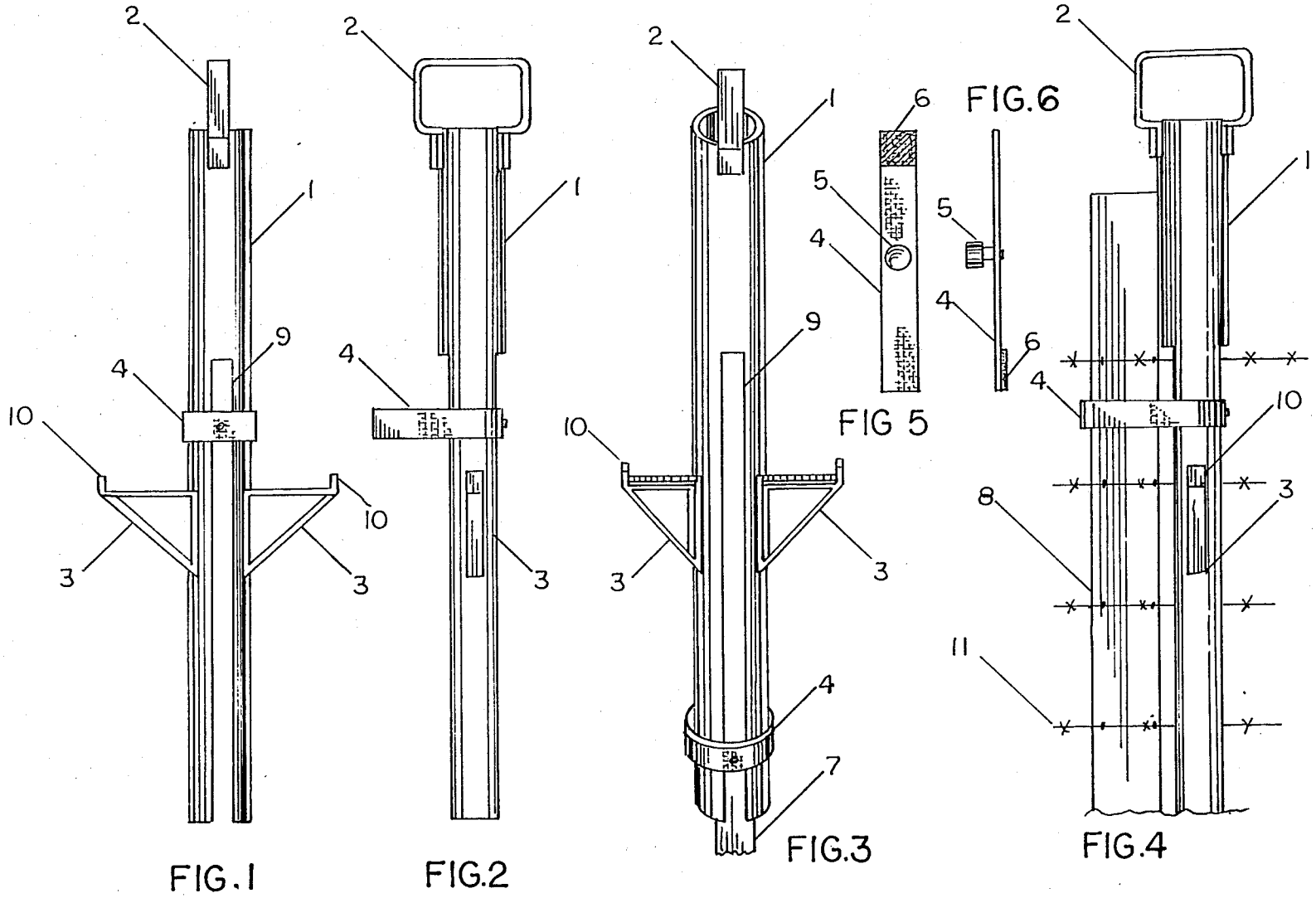
FIG. 1 is a front elevation of the portable fence stile.
FIG. 2 is a left side elevation of the portable fence stile.
FIG. 3 is a top front perspective of the portable fence stile enclosing a metal fence post.
FIG. 4 shows the portable stile fastened to a wood fence post.
FIG. 5 is a plan view of the pliable support strap.
FIG. 6 is a side view of the pliable support strap.

Referring to FIG. 1 a front view of the portable fence stile 1 is shown with the top handle 2, horizontal steps 3 with non-slip end 10 and pliable support strap 4 positioned over the longitudinal slot 9. FIG. 2 shows the portable fence stile 1, the top handle 2, the horizontal step 3 and the pliable support strap 4. The perspective view of FIG. 3 shows the portable fence stile encasing the metal fence post 7 and the pliable support strap 4 positioned on the lower portion of the stile. In FIG. 4 the portable fence stile is shown fastened to the wood fence post 8 with the horizontal wire 11 by the pliable support strap 4. FIG. 5 is a plan view of the pliable support strap 4 with the slot engaging nodule 5 and the Velcro covering 6 on the end portion of the strap.

FIG. 6 is a side view of the pliable support strap 4 with the nodule 5 and the Velcro covering 6.

I claim:

1. A portable fence stile that is placed over a fence having spaced horizontal wires supported by metal, or wood, vertical posts wherein the improvement comprises:

a. a vertical metal tube having a length sufficient to extend above the fence post;

b. the tube having an inside diameter sufficient to accommodate a vertical metal fence support post;

c. the tube having longitudinal slots on opposite sides;

d. the slots extending upwards from the bottom of the tube to a height sufficient to clear the top horizontal fence wire;

e. horizontal foot rests with upwardly extended outside ends a stepping distance up from the bottom of the tube between the tube slots;

f. the tube having a rigid horizontal handle at the top;

g. a pliable fabric, or leather, strap slidably affixed to the tube slots; and, h. the strap fastened in a closed loop by means of Velcro, a buckle or other fastening means.

* * * * *